United States Patent [19]

Goettl

[11] Patent Number: 4,687,604

[45] Date of Patent: Aug. 18, 1987

[54] FLOOR PAN FOR EVAPORATIVE COOLERS

[76] Inventor: Adam D. Goettl, 4960 E. Palomino Rd., Phoenix, Ariz. 85018

[21] Appl. No.: 16,492

[22] Filed: Feb. 18, 1987

Related U.S. Application Data

[63] Continuation of Ser. No. 776,854, Sep. 17, 1985, abandoned.

[51] Int. Cl.[4] ..... B01D 47/00; F02M 69/02

[52] U.S. Cl. ..... 261/29; 62/288; 62/291; 62/304; 261/72.1; 261/106

[58] Field of Search ..... 62/285, 288, 291, 304, 62/305; 261/72.1, 106, 29

[56] References Cited

U.S. PATENT DOCUMENTS

| | | | |
|---|---|---|---|
| 3,479,948 | 11/1969 | Mathews | 62/285 |
| 3,724,233 | 4/1973 | Pugh et al. | 62/285 |
| 4,419,300 | 12/1983 | Van Ness et al. | 62/304 |
| 4,479,366 | 10/1984 | Lanier et al. | 62/304 |

FOREIGN PATENT DOCUMENTS

| | | |
|---|---|---|
| 1131085 | 2/1957 | France . |
| 887959 | 1/1962 | United Kingdom . |

*Primary Examiner*—Ronald C. Capossela
*Attorney, Agent, or Firm*—Herbert E. Haynes, Jr.

[57] ABSTRACT

A floor pan for use in the cabinet of an evaporative cooler is formed with an elevated central platform which is surrounded by an endless upwardly opening trough for containing the operating water supply of the evaporative cooler. The floor pan is configured so that the endless trough is disposed below the wettable pads of the evaporative cooler so as to catch unevaporated water returning from the pads to the water supply, and the trough is sized so as to be as small as possible to facility periodic draining and replacement of the water supply and otherwise reduce water induced damage of the cooler.

15 Claims, 5 Drawing Figures

FIG. 1
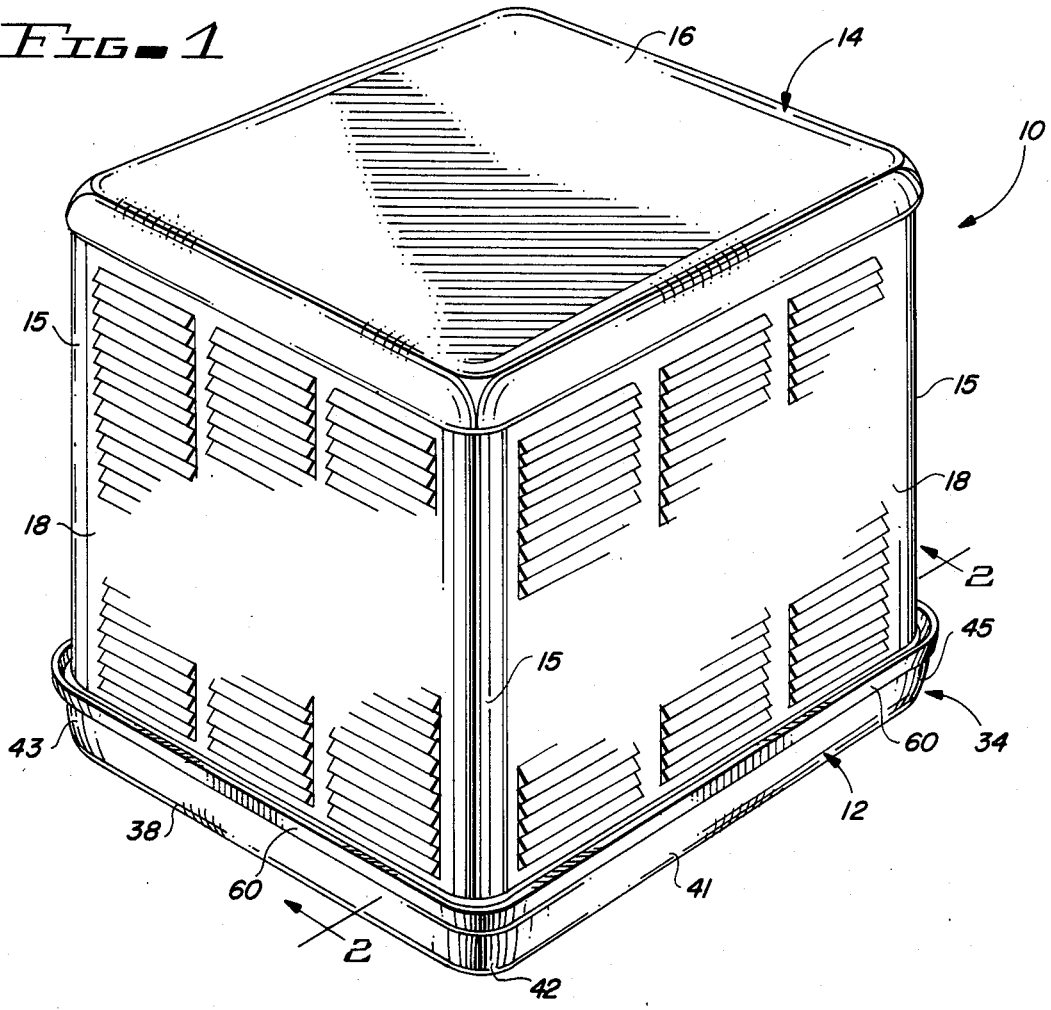
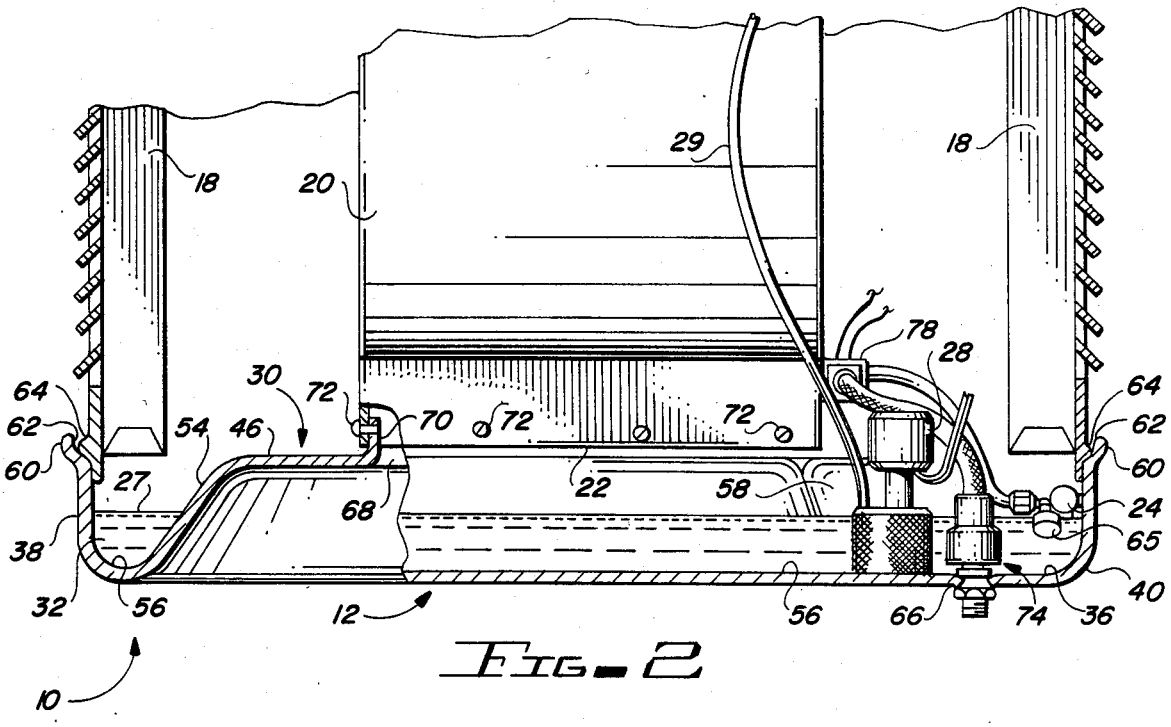
FIG. 2

FLOOR PAN FOR EVAPORATIVE COOLERS

This is a continuation of co-pending application Ser. No. 776,854 filed on Sept. 17, 1985, now abandoned.

BACKGROUND OF THE INVENTION

1. Field of the Invention

This invention relates generally to evaporative cooler structures and more particularly to a new and improved floor pan structure which forms the water reservoir in a cooler cabinet.

2. Description of the Prior Art

Evaporative coolers of the type having an air handler mounted within a cabinet for drawing ambient air into the cooler through wetter cooler pads and delivering the evaporatively cooled air to a point of use, have the necessary cooler operating water supply contained within the floor pan of the cooler cabinet. The water level within the floor pan is maintained at a predetermined level by a float controlled water inlet valve which is connected to a source of fresh water under pressure, such as a municipal water supply line. The float controlled water inlet valve operates to supply fresh make-up water to replace that lost by evaporation during operation of the cooler. A pump is mounted in the floor pan and operates to supply the water in the floor pan to the cooler's water distribution plumbing system which directs the pumped water to the tops of the cooler pads. The water so delivered to the pads will trickle down through the pads under the influence of gravity. The wet cooler pads will cool the air being drawn therethrough by the air handler in accordance with the well known evaporative principles, and the unevaporated water will drain from the cooler pads back into the floor pan for recirculation.

During such operation, the water, which inherently contains minerals, such as sodium and calcium chlorides and other impurities, will increase as to its concentration of those minerals due to the evaporation process. As the mineral concentration increases, the rate of precipitation will also increase which results in mineral deposits, or scaling, of the various cooler components, and this problem is of particular concern with respect to the damage it inflicts on the electric motors and associated electrical elements of the cooler.

In addition to the mineral build-up problem, other contaminants will collect in the water supply contained in the floor pan due to the air washing effect which occurs as a result of drawing ambient air through the wet cooler pads. A relatively large percentage of airborne pollen, dust, and the like, will be washed out of the ambient air as it passes through the cooler pads, and such contaminants will be carried by the water into the floor pan of the cooler cabinet. These contaminants are detrimental to useful cooler life and efficient cooler operation of course, and a major concern relating to such airborne contaminants is bacteria. Airborne bacteria, which is washed from the incoming air into the water supply contained in the cooler's floor pan, is responsible for musty odors, which often accompany the cooled air delivered to the point of use. Further, such bacteria is responsible for fungi, algae and other Thallophyta growths which can, and very often occur in evaporative coolers.

The floor pan structures which have been used in most evaporative coolers for many years are open top pan shaped structures having a flat bottom with an endless upstanding sidewall which suitably supports the corner posts of the cooler cabinet and the cooler pads. And, in the case of a downdraft type of evaporative cooler, i.e., one in which the cooled air is delivered downwardly from the cooler to a point of use, the floor pan will also have a riser duct mounted therein which serves as a support for the air handler and means for conducting the evaporatively cooled air out of the cooler.

Due to the flat bottom configuration of the prior art floor pans and the size required to support the upper portions of the cooler cabinets, such floor pans inherently contain far more water than is necessary for operation of the evaporative cooler. And, the water level in such floor pan structures must be of sufficient depth for proper operation of the cooler's pump. For example, a 6500 C.F.M. evaporative cooler, which is normally the largest residential cooler used, will have a floor pan water storage capacity of about 20 to 22 gallons. This is considerably more than is required in that in operation, the cooler of the above mentioned example will only hold approximately 3 gallons of water in its water distribution plumbing network and in its pads.

In addition to this overly large water supply contained in the prior art floor pans, they present a very large water surface area in that such pans are usually about 4 to 5 inches deep. Therefore, the cooler cabinet and its various components are continuously being subjected to the damaging effects of a water body having an excessively large surface area.

It will be appreciated from the above that evaporative coolers per se, and more particularly the water supply and the floor pan of prior art evaporative coolers become severly contaminated during operation of the cooler. This is well known in the art and thus manufacturers as well as installation personnel strongly recommend that the owners, or users of such coolers periodically drain the contaminated water from the floor pan, clean it and refill the floor pan with fresh water, and the more frequent that this servicing is accomplished, the better.

The prior art floor pans make such servicing difficult, in that a considerable surface area of the floor pan is under water during cooler operation. Thus, almost the entire inner surface of the floor pan must first be rinsed, usually with a pressurized water stream from a garden hose, to flush dirt and other loose contaminants from the corners, flat bottom surface, and effected vertical surfaces of the pan. Then those surfaces must be scrubbed, sometimes with a wire brush, to remove slime, caked mineral deposits, flaking paint and/or other coating materials, and rust. It is recommended that any exposed metal parts be recoated, such as with an asphalt based coating, and then the cooler is ready to be refilled with fresh water and put back into service.

To help overcome some of these problems associated with the prior art, automatic flushing, draining and water replacing devices have been proposed, and those devices are fully disclosed in U.S. Pat. Nos. 4,192,832; 4,255,361; 4,289,713; 4,333,887 and 4,361,522 which issued to Adam D. Goettl. In those patents, a relatively small reservoir tank is provided immediately below an opening provided in the flat bottom surface of the cooler's floor pan. This reservoir tank contains about one gallon of water, which in addition to the approximately 3 gallons in the cooler's plumbing supply network and pads, results in a substantial decrease in the water supply in comparison to the 20 or so gallons which constitutes the water supply of a cooler which is not provided with such a reservoir tank. Further, the reservoir tank has considerably less water surface area in comparison to the cooler's floor pan. The unevaporated water returning from the cooler pads to the reservoir tank will flow through the floor pan into the reservoir tank and the flushing, draining and water replacing device is contained in and associated with the reservoir tank so as to automatically dump the cooler's water supply and replace it with fresh water at predetermined intervals. This virtually overcomes all the above described problems associated with the prior art water supplies, floor pans and other components of the evaporative coolers.

Even with all of the advantages mentioned above, one problem still exists in evaporative coolers which are equipped with the automatic flushing and draining devices described above, and that problem is a direct result of the long used flat bottom prior art cooler floor pans. In theory, the water passing through those floor pans on its way to the reservoir tank will continuously rinse the floor pan and thus keep it clean and contamination free. In actual practice however, this is not the case. Prior art floor pans of evaporative coolers are not precision structures and their flat bottom surfaces are not truly flat, and they are not necessarily in a truly horizontal plane when the coolers are installed. This, along with the fact that returning water will not rinse all the surface area of the flat bottoms, can result in standing puddles of virtually stagnant water while other surface areas receive little or no rinsing.

Therefore, a need exists for a new and improved floor pan structure for use in evaporative coolers which helps overcome some of the problems and shortcomings of conventional prior art evaporative coolers, and contributes significantly to the effective operation of evaporative coolers equipped with the above mentioned automatic flushing and draining mechanisms.

SUMMARY OF THE INVENTION

In accordance with the present invention, a new and improved floor pan structure for evaporative coolers is disclosed which overcomes, or at least substantially reduces, the prior art problems and shortcomings associated with evaporative coolers having their operating water supply contained within flat bottom floor pans, and for improving the operation of coolers equipped with the hereinbefore discussed automatic flushing and draining devices.

The improved floor pan of the present invention is preferably a unitary one-piece structure which may be formed such as by employing a drawing operation, a molding operation, or the like. The floor pan is configured to define an endless upstanding sidewall, a central platform and an endless trough which is disposed within the sidewall in surrounding relationship with the platform. The central platform includes a substantially planar surface which defines an upper surface of the floor pan, and the trough defines a lower surface thereof, and the area of the lower surface is considerably smaller than the area of upper surface.

The lower surface of the floor pan, e.g. the bottom of the endless trough, is provided with a widened, or enlarged, area in which the cooler's pump and float controlled water inlet valve are mounted. If the evaporative cooler is to be equipped with the hereinbefore mentioned automatic flushing and draining device, it too is mounted in the widened area of the endless trough.

A water supply of sufficient depth for proper operation of the cooler's pump, is provided in the trough of the floor pan and the water supply is considerably smaller, both in total quantity and surface area, than that required for proper cooler operation in prior art coolers having flat bottom floor pans.

Such a reduction in the quantity and surface area of the evaporative cooler's operating water supply will reduce the water induced damage and contamination of the entire cooler in general and of the floor pan in particular. The unevaporated water returning from the cooler's pads will drop under the influence of gravity directly into the endless trough portion and none of the is unevaporated water that is returning to the water supply will fall on the central platform portion of the floor pan.

The floor pan structure of the present invention may be utilized in either of two ways. First, a conventional overflow pipe may be mounted in the outlet opening of the floor pan, e.g. on the lower surface of the floor pan in the widened area of the trough portion thereof, and locating the cooler's pump and float controlled water inlet valve in that same area. When so equipped, the evaporative cooler will operate much in the same manner as a conventional evaporative cooler and will have the above described advantages associated with the floor pan structure of the present invention. The second way of utilizing the floor pan structures of the present invention is to mount one of the automatic flushing and draining device of the hereinbefore referenced U.S. Patents therein so that the automatic flushing and draining capabilities of that device will complement the advantages of the floor pan structure of the present invention.

Accordingly, it is an object of the present invention to provide a new and improved floor pan structure for evaporative coolers.

Another object of the present invention is to provide a new and improved floor pan structure for evaporative coolers which is configured to substantially reduce the quantity and surface area of the cooler's operating water supply in comparison to that required in prior art cooler structures.

Another object of the present invention is to provide a new and improved floor pan structure for evaporative coolers which locates the cooler's operating water supply in a relatively small localized area within the floor pan for reducing the quantity and surface area of the water supply for reducing water induced damage and contamination of the cooler per se and the floor pan in particular.

Another object of the present invention is to provide a new and improved floor pan structure for evaporative coolers which locates the cooler's operating water supply within an endless trough that is located immediately below the wettable pads of the evaporative cooler so as to catch the unevaporated water returning from the pads to the water supply and thereby contain the water supply in a relatively small localized area of the floor pan.

The foregoing and other objects of the present invention as well as the invention itself, may be more fully understood from the following description when read in conjunction with the accompanying drawings.

BRIEF DESCRIPTION OF THE DRAWINGS

FIG. 1 is a perspective view of an evaporative cooler which includes the improved floor pan structure of the present invention.

FIG. 2 is an enlarged fragmentary sectional view taken along the line 2—2 of FIG . 1.

DESCRIPTION OF THE PREFERRED EMBODIMENT

Figure 3:
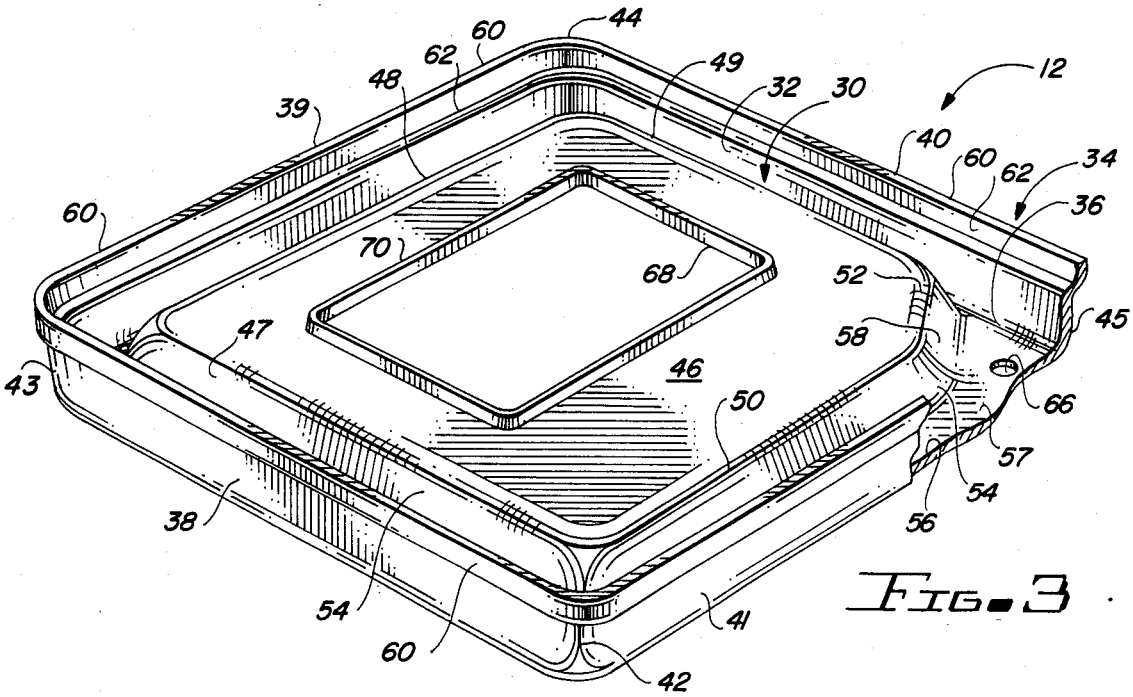
FIG. 3 is a perspective view of the improved floor pan structure of the present invention with a portion thereof being broken away to illustrate the various features thereof.

Referring more particularly to the drawings, FIG. 1 shows a typical evaporative cooler, which is indicated generally by the reference numeral 10, with the evaporative cooler including the floor pan structure of the present invention which is indicated in its entirity by the reference numeral 12.

The evaporative cooler 10 includes a cabinet assembly 14, of which the floor pan 12 forms a part, and having the usual corner posts 15 which supportingly interconnect the floor pan and a roof structure 16, and wettable cooler pad assemblies 18 which are demountably carried in the sides of the cooler cabinet.

As seen in FIG. 2, the illustrated typical cooler 10 is also provided with an air moving blower assembly 20 internally of the cabinet 14 which is supported on and fixedly mounted in the floor pan 12 as will hereinafter be described in detail. The blower assembly 20 has an outlet end 22 from which evaporatively cooled air is coupled to a point of use externally of the cabinet 14, such as by an air delivery duct network (not shown) which conducts the air to a point or points of use in a building structure.

The cooler 10 also has a float operated water inlet valve 24 mounted therein in a manner which will hereinafter be described, such as by the bracket 25, and is coupled by means of a water inlet pipe 26 to an external remote source of fresh water (not shown) such as a municipal water supply line. The water inlet valve functions to initially supply water to provide the cooler's operating water supply 27 and to maintain it at a predetermined level by supplying fresh make up water to the supply 27 to replace that lost by evaporation during operation of the cooler.

A conventional pump 28 is mounted in the floor pan 12 of the cooler 10 and operates to deliver water under pressure from the water supply 27 through a suitable plumbing network 29 which carries the water to the upper portion of the cooler's cabinet 14 and distributes it to the top of each of the cooler pads 18. The water will trickle down through the pads 18 under the influence of gravity and thus, wet the pads.

Since evaporative coolers are well known in the art, it is not deemed necessary to completely illustrate all the structural details thereof and only a brief description of operation will be given to facilitate understanding of the present invention.

Typically, the air moving blower assembly 20 is operated to exhaust air from the interior of the cooler cabinet 14 and in doing so will create a negative static pressure within the cabinet. This will cause warm ambient air to be drawn through the wet cooler pads 18 into the cabinet and the incoming air will be cooled by the well known evaporation principle as it enters the cabinet. As a result of the evaporation process taking place, some of the water which passes downwardly through the pads 18 will be lost because of the evaporation and the unevaporated water will return to the water supply 27 for recirculation.

It will be understood that the structural details of the above described evaporative cooler 10 are merely exemplary of such structures. For example, the illustrated cooler 10 is of the type known in the art as a downdraft cooler, in that its evaporatively cooled air output is directed downwardly through the floor pan 12 to a point of use. In structures of this type, there is normally four of the described wettable cooler pads 18, i.e., one in each of the sides of the cabinet. Another type of evaporative cooler (not shown) in common usage is known as a sidedraft evaporative cooler, in that its evaporatively cooled air is delivered through one side of the cooler cabinet. In this type of cooler, there are only three wettable cooler pads.

As seen best in FIG. 3, the floor pan 12 of the present invention is formed as a four sided structure to match the configuration of the illustrated evaporative cooler 10. It will be noted that other evaporative cooler configurations have been used, such as a round cooler (not shown) and one having more than four sides (not shown), and the floor pan 12 may be configured to match virtually any evaporative cooler design.

In any event, the floor pan 12 is preferably a unitary one-piece structure which may be formed by a well known drawing technique wherein a sheet of material, such as sheet metal, is drawn into the desired configuration. Alternatively, the floor pan could be formed by molding a suitable synthetic resin in the desired shape.

The floor pan 12 is configured to define the major parts of a elevated central platform 30 which is surrounded by an endless upwardly opening trough 32 which is, in turn, surrounded by an endless upstanding sidewall 34. And, the floor pan is configured to provide an enlarged area 36 in the trough 32.

In the illustrated embodiment, the floor pan 12 is of substantially square configuration. Therefore, the central platform 30, the endless trough 32 and the endless sidewall 34 are also of substantially square configuration. Therefore, the endless upstanding sidewall 34 is formed of four sidewall segments 38, 39, 40 and 41 which are integral with respect to each other and cooperate to provide the floor pan 12 with four corners 42, 43, 44 and 45.

The elevated central platform 30 includes a planar upper surface 46 which is defined by four side edges 47, 48, 49 and 50, each of which is spaced inwardly and parallel with respect to a different one of the sidewall segments 38, 39, 40 and 41, and by a diagonal edge 52 which faces the corner 45 of the floor pan 12. An endless wall 54 depends integrally and angularly from the side edges 47, 48, 49 and 50 and from the diagonal edge 52 of the platform 30.

The lower ends of the endless sidewall 34 are curved inwardly and the lower ends of endless wall 54 of the central platform 30 are curved outwardly and those lower ends cooperatively provide the endless trough 32 with a bottom surface 56. The bottom surface 56 of the trough 32 is substantially planar in an area 57 thereof which is between the diagonal portion 58 of the endless wall 54 and the corner 45 of the floor pan 12. That area defined by the diagonal wall portion 58, the planar area 57 of the bottom of the trough 32 and corner 45 of the floor pan is the above mentioned enlarged area 36 of the trough 32. As seen best in FIG. 2, the remaining bottom surface area 56 of the trough 32 is preferably of upwardly curved cross sectional configuration.

As seen best in FIG. 2, the width dimension of the endless trough 32 proximate its open upper end is just sleightly larger than the thickness dimension of the cooler pad assemblies 18. In this way, the unevaporated water returning from the pads 18 to the floor pan 12 will be received in the trough portion 32 thereof and the size of the water reservoir will be as small as possible. The actual size of the trough 32 will be essentially the same, e.g. the open upper end of the trough will be about 3 inches across in most evaporative coolers. As a result of this, the total open area of the endless trough 32 will be substantially smaller than the area of the upper planar surface 46. Traditionally, evaporative coolers are available in several sizes and thus the floor pans will be of different sizes. For example, one cooler in common use will have a floor pan which is square and measures 34 inches on a side. When the floor pan of the present invention is fabricated for use in that particular cooler, the area of the opening of the endless trough will be approximately 372 square inches, not counting the enlarged corner area, and the area of the planar upper surface 46 of the platform means will be approximately 784 square inches, again not counting that portion of the surface 46 which is removed to provide the enlarged corner area of the trough. Therefore, in this particular example the open area of the trough 32 is less than half of the area of the planar upper surface 46 of the platform means. Another evaporative cooler in common use measures 60 inches on a side and is also of square configuration. When the floor pan 12 of the present invention is sized for use in this particular cooler, the area of the planar upper surface 46 of the platform means will be approximately 2916 square inches and the open area of the trough 32 will be approximately 684 square inches. From these areas, which as in the first example, are calculated without taking into account the enlarged corner area of the trough 32, it will be seen that the area of the opening of the trough 32 is less than one fourth of the area of the planar upper surface 46 of the platform means.

For reasons which will hereinafter be described in detail, the endless sidewall 34 of the floor pan structure 12 is formed with an outwardly offset upstanding lip 60 on the endless upper edge thereof and this provides an endless shoulder 62 which is disposed inwardly of the lip.

The above described floor pan structure 12 is employed in forming the cabinet 14 of the evaporative cooler 10 by locating the lower ends of the cooler's corner posts 15 in the corners 42, 43, 44 and 45 of the floor pan and suitably fastening the posts therein such as by spot welding or the like. The wettable cooler pad assemblies 18 are demountably positioned between the corner posts 15 of the cooler cabinet in the well known manner so that the lower edges of the pad frames are supported by the upper edge of the endless sidewall 34 of the floor pan 12. Such supporting may be accomplished for example, by forming a bead 64 on the wettable pad frame proximate the lower edge thereof and mounting the pad assembly 18 so that the bead 64 is in resting engagement with the above mentioned shoulder 62 formed along the upper edge of the endless sidewall 34 of the floor pan 12. When mounted in this manner, as shown best in FIG. 2, it will be seen the off-set upstanding lip 60 is disposed outwardly relative to the lower edge of the cooler pad assemblies 18 so that the endless lip 60 acts like a trough to catch any water which could othewise drop from the pads exteriorly of the cooler cabinet 14. Any water caught by the lip 60 will therefore flow back into the cooler's floor pan 12 rather than dropping from the cabinet.

Figure 4:
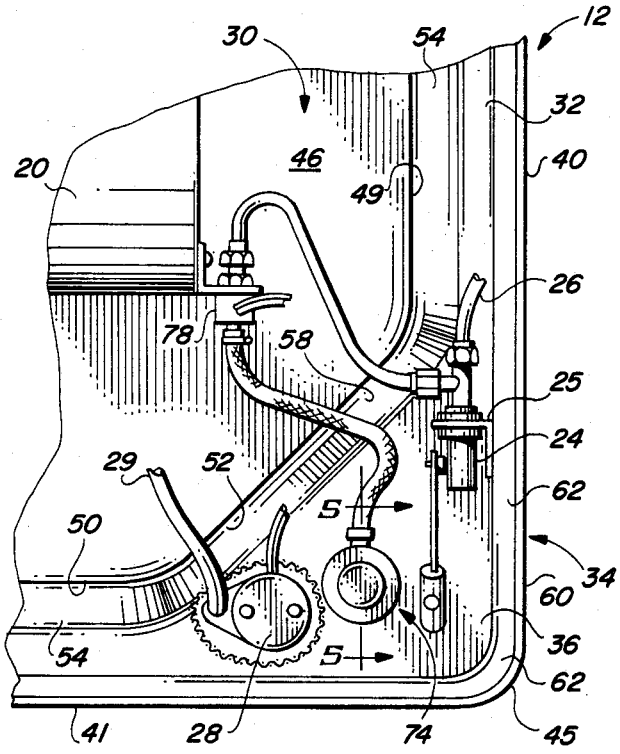
FIG. 4 is an enlarged fragmentary plan view of a portion of the floor pan structure having a pump, a float controlled water inlet valve and a particular type of automatic flushing, draining and water replacing device installed therein.

As shown in FIGS. 2 and 4, the cooler's pump 28 is mounted on the planar surface portion 57 of the bottom surface of the enlarged area 36 of the trough 32 that is provided in the floor pan 12 of the present invention. Also, the float operated water inlet valve is suitably mounted such as by attaching the bracket 25 to the sidewall 34, so that its float 65 is operative in the enlarged area 36 of the endless trough 32. In this manner, the cooler's water supply 27 is initially supplied to the endless trough 32 and is maintained at approximately at the level shown in FIG. 2.

With the floor pan 12 of the present invention configured as described above, it will be seen the unevaporated water returning from the cooler pad assemblies 18 during operation of the cooler 10 will fall into the endless trough 32. Thus, the total amount and surface area of the cooler's water supply 27 will be substantially reduced in comparison to the water supply of prior art evaporative coolers.

The floor pan structure 12 is provided with a drain outlet opening 66 in the flat surface portion 57 of the trough 32, and a conventional overflow pipe (not shown) may be mounted therein as is customary in known evaporative cooler structures. Alternately, the outlet opening 66 may be otherwise employed as will hereinafter be described in detail.

The floor pan structure 12 as thus far described is suitable for use in the types of cooler structures known as sidedraft coolers as hereinbefore discussed. When the floor pan structure 12 is to be employed in a downdraft cooler of the type shown in FIG. 1 and 2, an appropriately sized opening 68 is formed in the planar surface 46 of the central platform 30 and an upturned endless flange 70 is formed about the opening 68. The outlet end 22 of the blower assembly 20 is attached to the flange 70 such as by sheet metal screws 72 as seen in FIG. 2.

Although the evaporative cooler 10 may be equipped with a conventional overflow pipe (not shown) so that the cooler will operate in the conventional manner, it is preferred that the cooler 10 be provided with means for automatically flushing, draining and replacing the water supply 27 at adjustably predetermined time intervals. To accomplish this type of operation, the cooler 10 is preferably equipped with the automatic flushing, draining and water replacement device of the type fully disclosed in U.S. Pat. No. 4,361,522.

Figure 5:
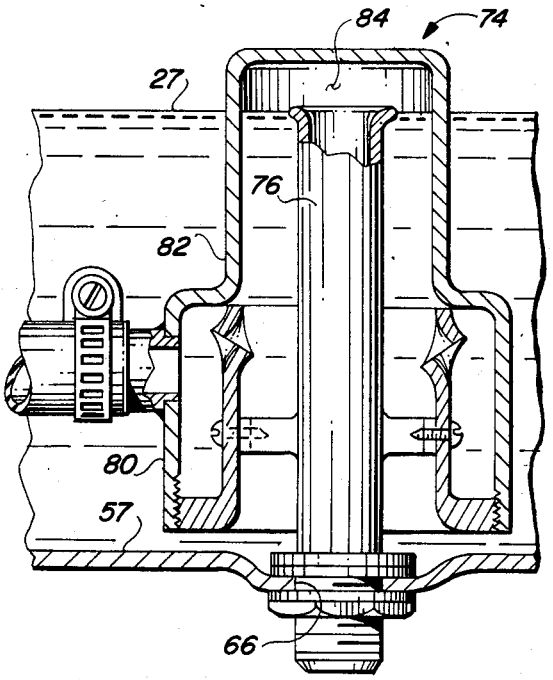
FIG. 5 is an enlarged sectional view taken on the line 5—5 of FIG. 4.

Briefly, the automatic flushing, draining and water replacement device includes a siphon drain valve 74 which is mounted in the outlet opening 66 of the floor pan 12 in the manner shown best in FIG. 5. During normal operation of the cooler 10, the water supply 27 will be at the level shown in FIG. 5, e.g. below the top of the standpipe portion 76 of the siphon drain valve. Therefore, the siphon drain valve 74 will be in the unprimed state. When the cooler is to be flushed, a normally closed solenoid valve 78 is opened for a relatively short period of time, such as by means of a suitable timing device (not shown), so that water under pressure from the supply line 26 is directed through the solenoid 78 into a positive priming mechanism 80 which is associated with the inverted cap structure 82 of the siphon drain valve 75. When this occurs, the incoming water will flood the area 84 between the upper end of the standpipe 76 and the top of the inverted cap 82 and thereby positively prime the siphon drain valve 74. When the siphon drain valve 74 is primed in this manner, the water supply 27 will be siphoned from the endless trough 32 of the floor pan 12 and the siphoning will continue until the water level falls below the lower end of the inverted cap 82 whereupon the siphon drain valve 74 will lose its prime. Incoming fresh water entering the cooler through the float controlled inlet valve 24 will provide a flushing action during the draining operation and will replace the water supply 27 with fresh water subsequent to the siphon drain valve losing its prime in the above described manner.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A floor pan for use in the bottom end of an evaporative cooler cabinet for containing the operational water supply of the evaporative cooler, said floor pan comprising:

(a) a platform (means) defining a planar upper surface:

(b) an endless upstanding sidewall in spaced surrounding relationship with respect to said platform , said sidewall defining an upper edge;

(c) an upwardly open endless trough between said platform and said upstanding sidewall for containment of the operating water supply of the evaporative cooler; and (d) said platform having its upper planar surface elevated relative to the bottom of said trough so as to be approximately level with the upper edge of said sidewall with the upper planar surface of said platform having a surface area which is greater than half of the total area of said floor pan for minimizing the quantity of the operating water supply containable in said trough.

2. A floor pan structure as claimed in claim 1 wherein said platform means, said upstanding sidewall and said endless trough are of unitary one piece construction.

3. A floor pan structure as claimed in claim 1 wherein the planar upper surface of said platform means has a single opening formed therethrough for directing evaporatively cooled air through said platform means to a point of use.

4. A floor pan structure as claimed in claim 1 wherein said platform means is configured to provide an enlarged area in said upwardly open endless trough for mounting of cooler operating devices therein.

5. A floor pan structure as claimed in claim 4 wherein the enlarged area of said upwardly open endless trough has an outlet opening formed in the bottom thereof in which a water outlet device means is mountable.

6. An evaporative cooler comprising in combination:

(a) a cooler cabinet having at least one open side;

(b) a wettable cooler pad demountably carried in the open side of said cooler cabinet; and (c) a floor pan which forms the bottom of said cooler cabinet and in which an evaporative cooler operating water supply is containable, said floor pan including, i. a central platform defining a planar upper surface, ii. an endless upstanding sidewall in spaced surrounding relationship with said platform iii. an endless trough between said platform and said upstanding sidewall for containment of the operating water supply, said trough being upwardly open with the area of the trough opening being smaller than the surface area of the planar upper surface of said platform for minimizing the quantity of the operating water supply containable in said trough.

7. An evaporative cooler as claimed in claim 6 wherein the area of the opening of said endless trough is less than one half of the area of the planar upper surface of said platform means.

8. An evaporative cooler as claimed in claim 6 wherein the area of the opening of said endless trough is less than one third of the area of the planar upper surface of said platform means.

9. An evaporative cooler as claimed in claim 6 wherein the area of the opening of said endless trough is less than one fourth of the area of the planar upper surface of said platform means.

10. An evaporative cooler as claimed in claim 6 and further comprising:

(a) said endless upstanding sidewall having an endless upper edge; and (b) said platform means being elevated so that the planar upper surface thereof is approximately level with the endless upper edge defined by said endless upstanding sidewall.

11. An evaporative cooler as claimed in claim 6 wherein said endless upstanding sidewall has an endless upper edge at least a portion of which is in engagement with the lower end of said wettable cooler pad, said upper edge of said upstanding sidewall being offset to provide a lip thereon which underlays the exterior surface of said wettable cooler pad for catching water that may fall therefrom and directing that water into said endless trough of said floor pan.

12. An evaporative cooler as claimed in claim 6 wherein said floor pan is of four sided configuration to provide said endless trough with four corner areas at least one of which is relatively larger than the others.

13. An evaporative cooler as claimed in claim 12 and further comprises:

(a) a pump mounted in the relatively larger corner area of said endless trough;

(b) a float controlled water inlet valve mounted in said floor an and having a float which is located in said endless trough of said floor pan; and (c) a water drainage means mounted in said endless trough of said floor pan.

14. An evaporative cooler as claimed in claim 6 and further comprising:

(a) blower assembly mounted in said cooler cabinet and having an air outlet end;

(b) a single opening formed through the planar upper surface of said platform and in communication with the air outlet end of said blower assembly for directing outlet air from said blower assembly through said platform.

15. An evaporative cooler as claimed in claim 6 wherein said floor pan is of unitary one-piece configuration.

* * * * *